US011479387B2

(12) United States Patent
Cheetham et al.

(10) Patent No.: US 11,479,387 B2
(45) Date of Patent: Oct. 25, 2022

(54) COLLAPSIBLE CONTAINERS

(71) Applicant: Saba Kuli Khan, Islamabad (PK)

(72) Inventors: Sarah Cheetham, Haslemere (GB); Kirstin Knox, Haslemere (GB)

(73) Assignee: Saba Kuli Khan, Islamabad (PK)

( * ) Notice: Subject to any disclaimer, the term of this patent is extended or adjusted under 35 U.S.C. 154(b) by 101 days.

(21) Appl. No.: 17/149,892

(22) Filed: Jan. 15, 2021

(65) Prior Publication Data

US 2022/0227530 A1 Jul. 21, 2022

(51) Int. Cl.

| | |
|---|---|
| ***B65D 21/08*** | (2006.01) |
| ***A47G 19/12*** | (2006.01) |
| ***B65D 37/00*** | (2006.01) |
| ***B65D 1/02*** | (2006.01) |

(52) U.S. Cl.

CPC ..... *B65D 21/086* (2013.01); *A47G 19/12* (2013.01); *B65D 1/0292* (2013.01); *B65D 37/00* (2013.01)

(58) Field of Classification Search

CPC .... B65D 21/086; B65D 1/0292; B65D 37/00; A47G 19/12; A45F 3/20

USPC ..... 220/9.2, 666, 8; 222/210, 475, 900; 206/218

See application file for complete search history.

(56) References Cited

U.S. PATENT DOCUMENTS 1,010,581 A * 12/1911 Burns ..... B65D 21/086 220/8
1,025,380 A * 5/1912 Curtis ..... B65D 1/265 206/218
1,037,068 A 8/1912 Smith
1,037,985 A 9/1912 Rengstorf
1,049,199 A * 12/1912 Bowman ..... B65D 21/086 220/8
3,014,621 A * 12/1961 Povitz ..... A47G 23/0266 222/88
5,960,983 A * 10/1999 Chan ..... B65F 1/02 220/666
6,431,406 B1 * 8/2002 Pruett ..... B65D 1/0292 220/666

(Continued)

FOREIGN PATENT DOCUMENTS

NL 9300045 A 8/1994

OTHER PUBLICATIONS

United Kingdom Search Report in corresponding United Kingdom Application No. GB1811482.7 dated Dec. 18, 2018, 1 page.

*Primary Examiner* — Andrew D Perreault

(74) *Attorney, Agent, or Firm* — MH2 Technology Law Group LLP

(57) ABSTRACT

A collapsible jug includes an upper member defining an opening and having a spout at a first side of the upper member. The jug has a lower member defining a base, and a collapsible side wall extending between the upper and lower members. The jug has a link that has a first end pivotally attached to the upper member at a second side of the upper member. The container is alterable between a collapsed configuration wherein the side wall is collapsed and a second end of the link is releasably attached to the spout such that the lower member is releasably retained between the link and the upper member and an in-use configuration wherein the side wall is extended and the second end of the link is releasably attached to the lower member such that the upper and lower members are releasably retained in a spaced apart configuration.

20 Claims, 4 Drawing Sheets

(56) References Cited

U.S. PATENT DOCUMENTS

| | | | | |
|---|---|---|---|---|
| 8,485,388 | B2 * | 7/2013 | Tuan | A47G 19/12<br>220/666 |
| 8,556,099 | B2 * | 10/2013 | Perlman | B65D 11/1873<br>206/217 |
| 2011/0303659 | A1 * | 12/2011 | Perlman | A45F 3/20<br>220/8 |

* cited by examiner

COLLAPSIBLE CONTAINERS

CROSS-REFERENCE TO RELATED APPLICATIONS

This patent application claims priority under 35 U.S.C. § 119 from UK patent application 1811482.7, filed Jul. 12, 2018, and published as GB 2575497 A on Jan. 15, 2020, the entire contents of all of which are incorporated by reference herein.

TECHNICAL FIELD

The present invention relates to improvements in collapsible containers, in particular the present invention relates to improvements in collapsible jugs.

BACKGROUND

Many collapsible containers have been proposed in the past including those described in U.S.2009183565 U.S. Pat. Nos. 492,900, 1,037,068, 1,025,380, 1,037,985.

The present invention seeks to improve upon the prior art.

SUMMARY

According to the present invention there is provided a collapsible jug comprising:

- an upper member defining an opening and having a spout at a first side of the upper member;
- a lower member defining a base;
- a collapsible side wall extending between the upper and lower members;
- a link that has a first end pivotally attached to the upper member at a second side of the upper member; the container being alterable between:
- a collapsed configuration wherein the side wall is collapsed and a second end of the link is releasably attached to the spout such that the lower member is releasably retained between the link and the upper member; and
- an in-use configuration wherein the side wall is extended and the second end of the link is releasably attached to the lower member such that the upper and lower members are releasably retained in a spaced apart configuration.

In some embodiments the link is releasably attachable to the lower member by releasable engagement of the link with at least one recess in the lower member.

In some embodiments the second end of the link comprises two flexible prongs that are adapted to engage with:

- the spout when the jug is in its collapsed configuration; and
- at least one recess formed in the lower member when the jug is in its in-use configuration.

In some embodiments each flexible prong comprises a projection configured to:

- releasably hook over a lip of spout when the jug is in its collapsed configuration; and
- releasably hook into respective indentations when the jug is in its in-use configuration.

In some embodiments the prongs are pivotable by a user to release the projections from their hooking positions.

In some embodiments when the jug is in its collapsed configuration the upper and lower members are connected together.

In some embodiments when the jug is in its in-use configuration the link is employable by a user as a handle.

Preferably when the jug is in its in-use configuration a space for a user's fingers is defined between the link and the side wall of the jug.

In some embodiments the link comprises a main elongate section and two substantially orthogonal terminal sections.

In order that the present invention may be more fully understood a specific embodiment will now be described by way of example with reference to the accompanying schematic drawings, of which:

BRIEF DESCRIPTION OF THE DRAWINGS

FIG. 3 illustrates how the container or FIG. 1 is moved from its in use configuration to its collapsed configuration.

DETAILED DESCRIPTION

Figure 1:
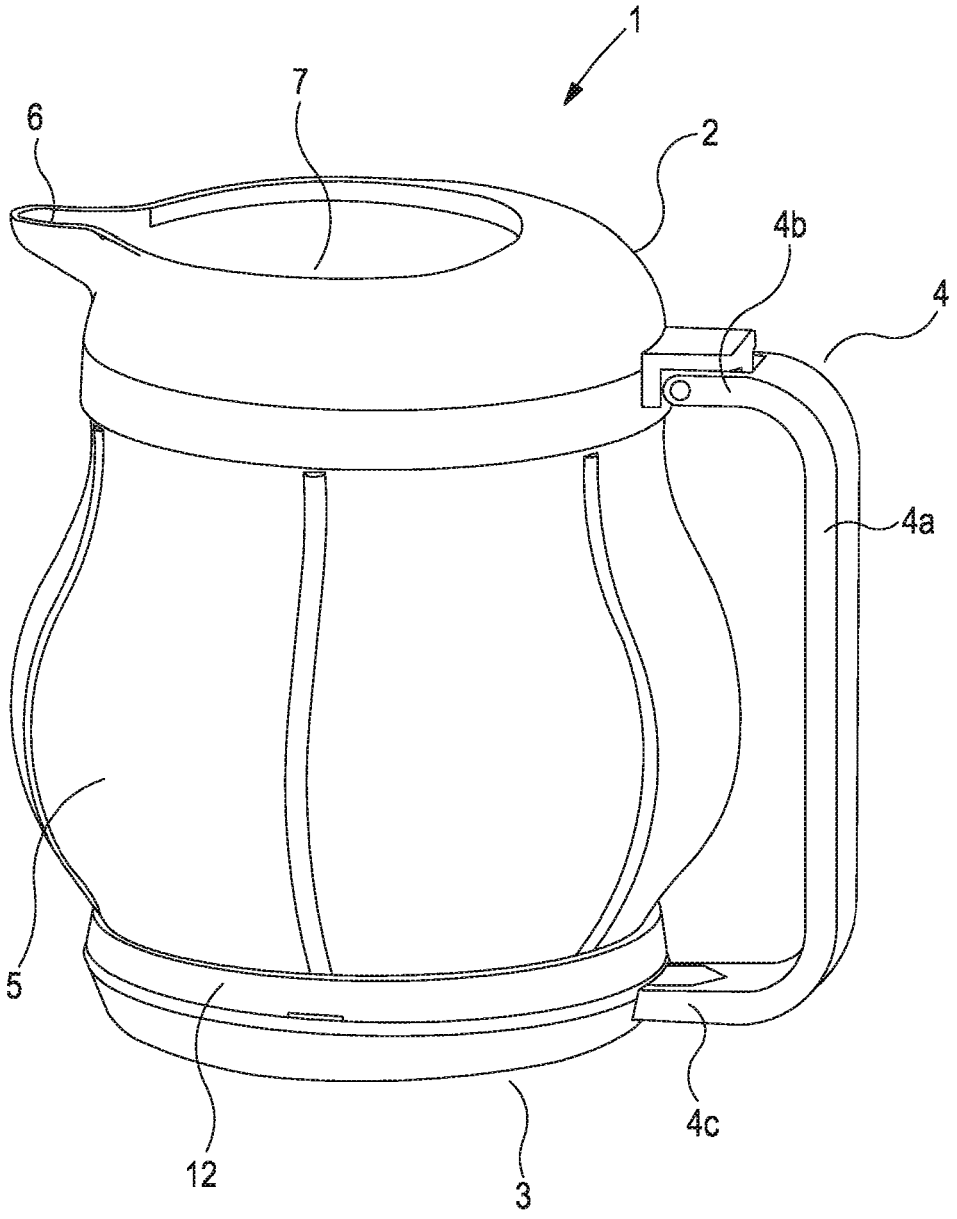
FIG. 1 is a perspective view of a container made in accordance with the present invention in its in-use configuration.

Referring to the drawings, container 1, in the form of a jug, comprises an upper member 2, a lower member 3, a handle 4 and a collapsible side wall 5.

Handle 4 is substantially [-shaped, comprising a main elongate section 4*a* and two substantially orthogonal terminal sections, namely an upper terminal section 4*b* and a lower terminal section 4*c*.

Upper terminal section 4*b* may be considered to comprise the first end of handle 4 and lower terminal section 4*c* may be considered to comprise the second end of handle 4.

Upper member 2, lower member 3 and handle 4 are all formed of a substantially rigid plastics material whereas side wall 5 is formed of a flexible material so as to allow it to collapse.

Upper member 2 is substantially cylindrical and comprises a substantially circular upper opening 7.

Upper member 2 comprises a spout 6 at a side of upper opening 7 of upper member 2. Pivotally attached to upper member 2 at a point diametrically opposite spout 6 is upper terminal section 4*b* of handle 4.

Figure 2:
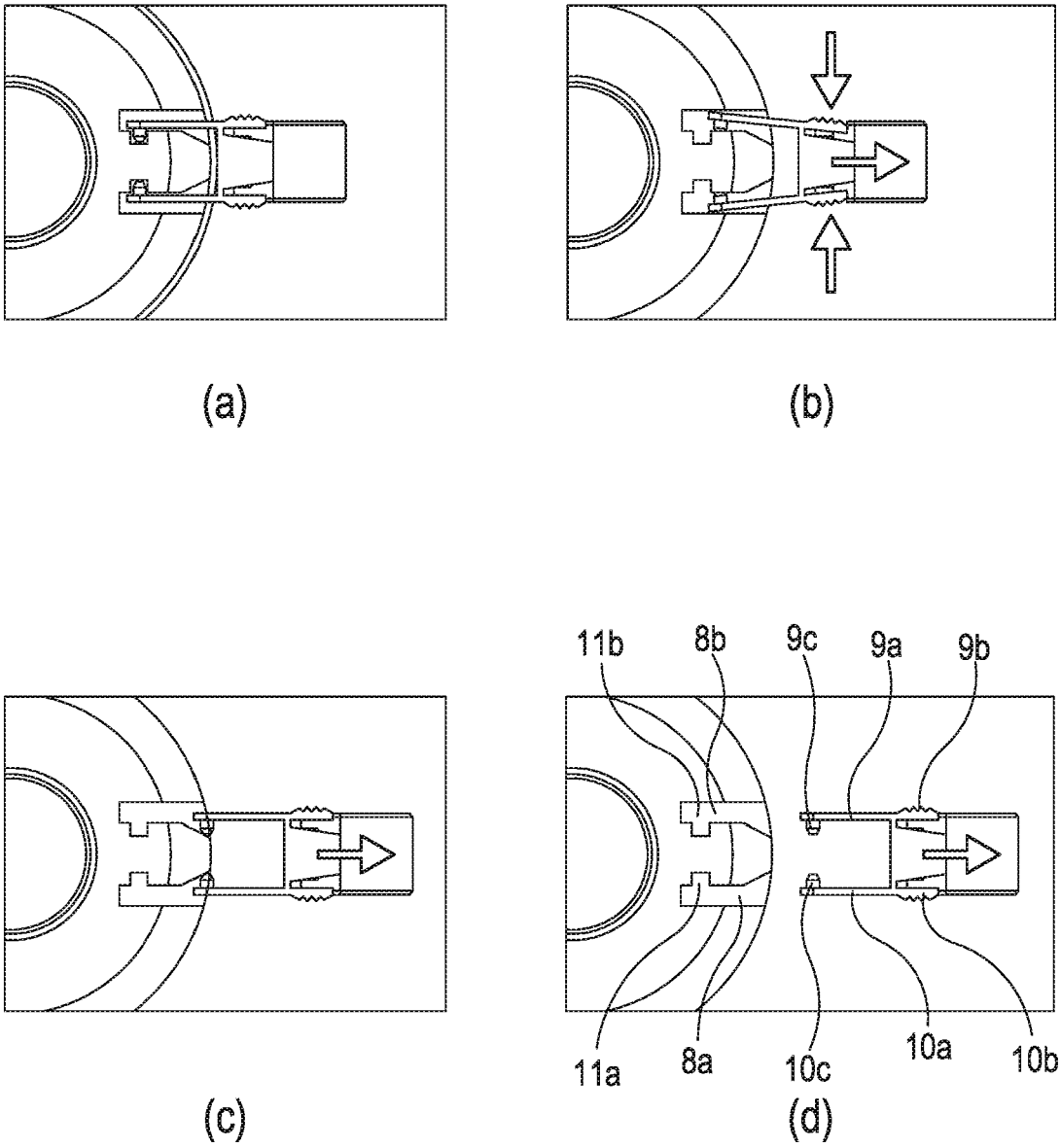
FIG. 2 illustrates how the free end of the handle of the container of FIG. 1 is disengaged from the base of the container of FIG. 1.

Referring to FIG. 2 and a sequence of four illustrations illustrating how lower terminal section 4*c* of handle 4 releasably attaches to lower member 3*b*, it can be seen that lower terminal section 4*c* of handle 4 comprises two prongs 9, 10.

Each prong 9, 10 comprises is pivotally mounted to lower terminal section 4*c* of handle 4 such that to one side of the pivot point at the end of handle 4 are located distal portions 9*a*, 10*a* of prongs 9, 10, and to the other side of the pivot point are located ribbed proximal portions 9*b*, 10*b*.

Adjacent the distal end of each prong 9, 10 is located a respective projection 9*c*, 10*c*.

Lower member 3 is substantially disc shaped and comprises at one side a pair of recesses 8*a*, 8*b*, which each comprise respective indentations 11*a*, 11*b*.

Distal portions of prongs 9*a*, 10*a* are configured to be housed within recesses 8*a*, 8*b* such that projections 9*c*, 10*c* mate with indentations 11*a*, 11*b*.

When projections 9*c*, 10*c* are mated with indentations 11*a*, 11*b* handle 4 as attached to both upper member 2 and lower member 3 such that handle 4 maintains upper member 2 and lower member 3 in a spaced-apart configuration and container 1 is in an 'in-use' configuration.

In this configuration a user may fill container 1 with liquid, transport the liquid, and pour the liquid from the container using spout 6.

To detach handle 4 from lower member 3 a user may squeeze proximal portions 9*b*, 10*b* of prongs 9, 10 so as to pivot the distal portions 9*a*, 10*a* of prongs 9, 10 away from each other and to disengage projections 9*c*, 10*c* from indentations 11*a*, 11*b*.

Distal portions 9*a*, 10*a* of prongs 9, 10 may then be removed from recesses 8*a*, 8*b* as handle 4 pivots away from lower member 3.

Figure 3:
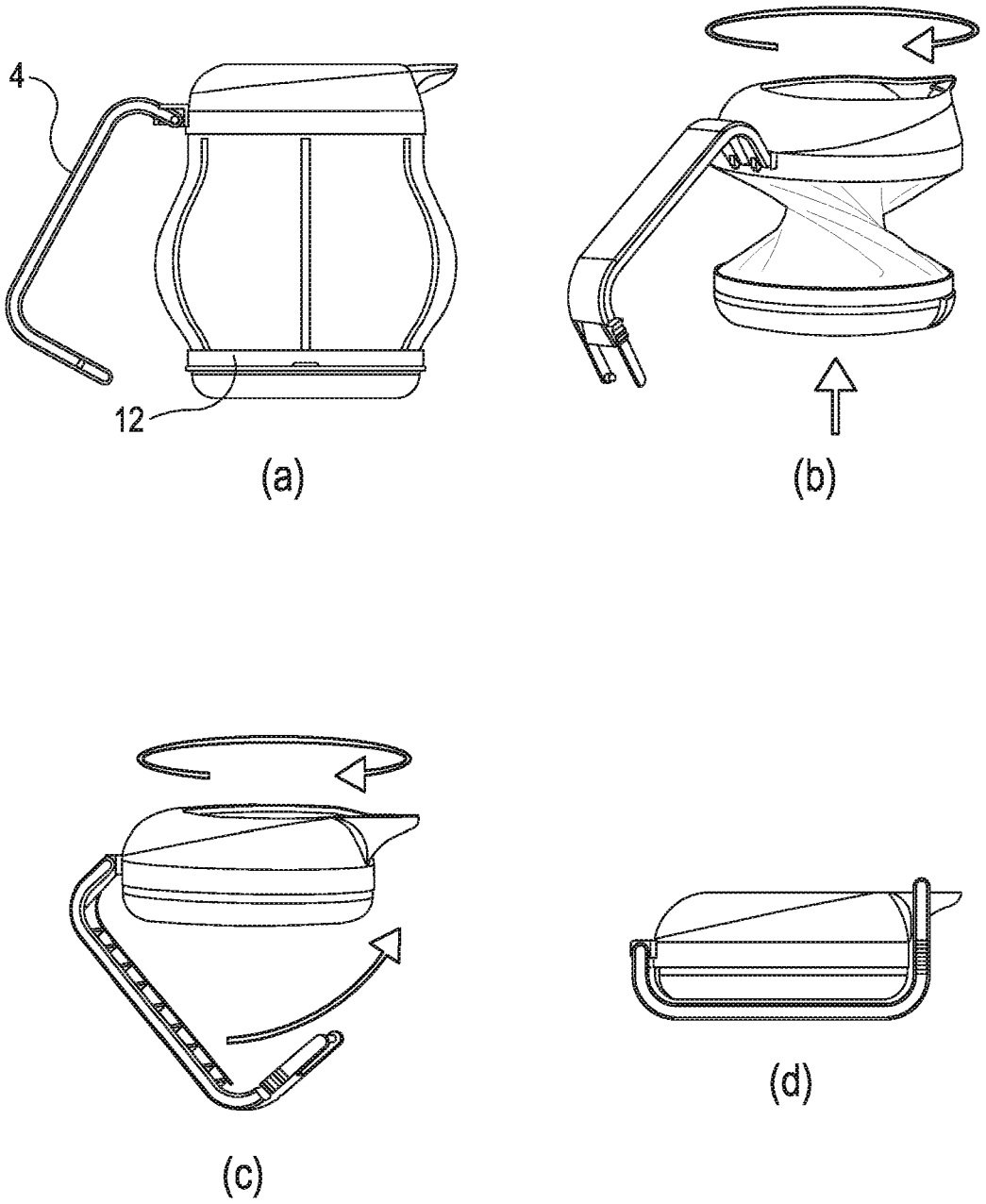

Once handle 4 is detached from lower member 3 container 1 may be transformed into its collapsed configuration as illustrated in FIG. 3.

In order to collapse container 1 a user may twist upper member 2 and lower member 3 relative to each other such that flexible side wall 5 winds up.

Upper member 2 and lower member 3 may then be connected to each other owing to an annular portion 12 of lower member 3 being sized so as to be housed snugly within upper member 2.

Figure 4:
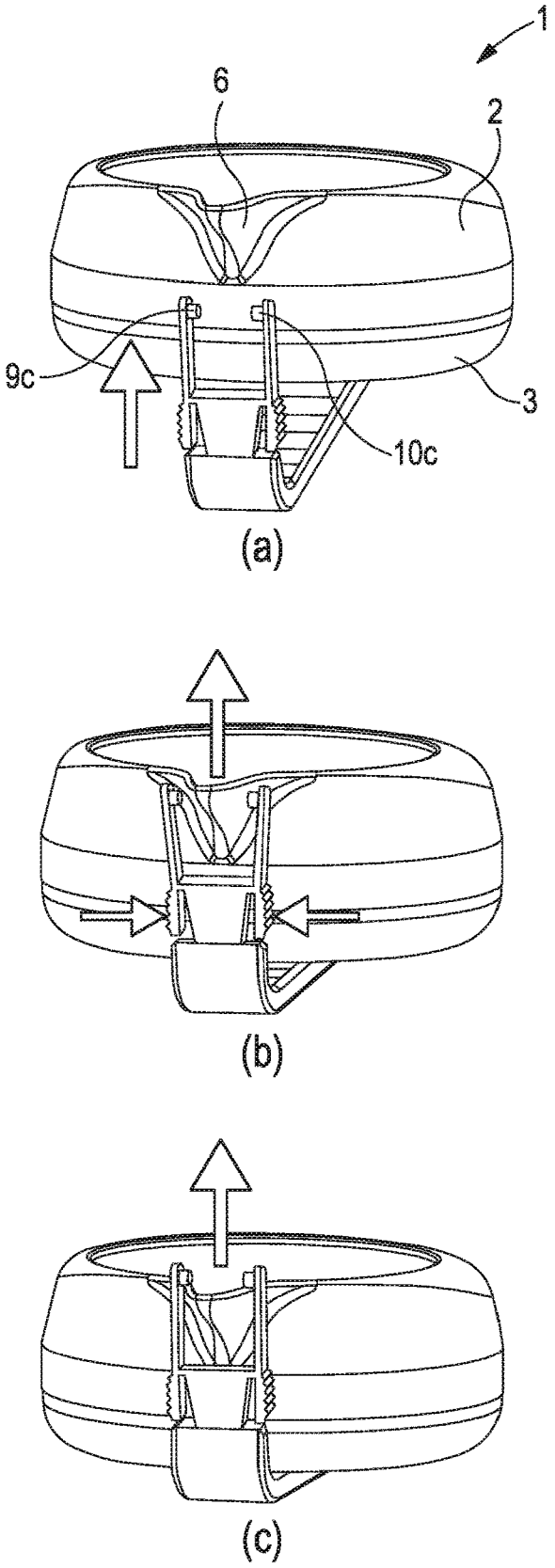
FIG. 4 illustrates how the free end of the handle of the container of FIG. 1 attaches to the spout of the container so as to releasably secure container 1 in it collapsed configuration.

In order to releasably secure container 1 in its collapsed configuration a user may then attach lower terminal section 4*c* of handle 4 to spout 6, as best illustrated in FIG. 4.

In this configuration projections 9*c*, 10*c* are hooked over the lip of spout 6 such that elongate portion 4*a* of handle 4 retains lower member 3 between handle 4 and upper member 2.

In this configuration lower member 3 is prevented from disengaging from upper member 2 owing to elongate portion 4*a* of handle 4.

To detach handle 4 from spout 6 of upper member 2 a user may squeeze proximal portions 9*b*, 10*b* of prongs 9, 10 so as to pivot the distal portions 9*a*, 10*a* of prongs 9, 10 away from each other and to disengage projections 9*c*, 10*c* from the lip of spout 6.

Handle 4 may then pivot away from spout 6 to be reattached to lower member 3 and reinstate container into its 'in-use' configuration.

Although in the present embodiment a handle 4 is used to releasably retain container 1 in two different configurations it will be appreciated that a linking member of another type may be employed, said linking member perhaps not usable as a handle when the container is in an 'in-use' configuration.

In most embodiments a link is likely to be substantially rigid but in some embodiments a link might be semi-rigid. A link may be formed of one or more pieces.

Many variations are possible without departing from the scope of the present invention as defined in the appended claims.

The invention claimed is:

1. A collapsible jug comprising:

an upper member defining an opening and having a spout at a first side of the upper member;

a lower member defining a base;

a collapsible side wall extending between the upper and lower members;

a link that has a first end pivotally attached to the upper member at a second side of the upper member; the container being alterable between:

a collapsed configuration wherein the side wall is collapsed and a second end of the link is releasably attached to the spout such that the lower member is releasably retained between the link and the upper member; and an in-use configuration wherein the side wall is extended and the second end of the link is releasably attached to the lower member such that the upper and lower members are releasably retained in a spaced apart configuration.

2. The jug of claim 1 wherein the link is releasably attachable to the lower member by releasable engagement of the link with at least one recess in the lower member.

3. The jug of claim 1 wherein the second end of the link comprises two flexible prongs that are adapted to engage with:

a. the spout when the jug is in its collapsed configuration; and b. at least one recess formed in the lower member when the jug is in its in-use configuration.

4. The jug of claim 2 wherein the second end of the link comprises two flexible prongs that are adapted to engage with:

a. the spout when the jug is in its collapsed configuration; and b. at least one recess formed in the lower member when the jug is in its in-use configuration.

5. The jug of claim 3 wherein each flexible prong comprises a projection configured to:

a. releasably hook over a lip of spout when the jug is in its collapsed configuration; and b. releasably hook into respective indentations when the jug is in its in-use configuration.

6. The jug of claim 4 wherein each flexible prong comprises a projection configured to:

a. releasably hook over a lip of spout when the jug is in its collapsed configuration; and b. releasably hook into respective indentations when the jug is in its in-use configuration.

7. The jug of claim 5 wherein the prongs are pivotable by a user to release the projections from their hooking positions.

8. The jug of claim 6 wherein the prongs are pivotable by a user to release the projections from their hooking positions.

9. The jug of claim 1 wherein when the jug is in its collapsed configuration the upper and lower members are connected together.

10. The jug of claim 1 wherein when the jug is in its collapsed configuration the upper and lower members are connected together.

11. The jug of claim 3 wherein when the jug is in its collapsed configuration the upper and lower members are connected together.

12. The jug of claim 4 wherein when the jug is in its collapsed configuration the upper and lower members are connected together.

13. The jug of claim 5 wherein when the jug is in its collapsed configuration the upper and lower members are connected together.

14. The jug of claim 6 wherein when the jug is in its collapsed configuration the upper and lower members are connected together.

15. The jug of claim 7 wherein when the jug is in its collapsed configuration the upper and lower members are connected together.

16. The jug of claim 8 wherein when the jug is in its collapsed configuration the upper and lower members are connected together.

17. The jug of 1 claim wherein when the jug is in its in-use configuration the link is employable by a user as a handle.

18. The jug of claim 17 wherein when the jug is in its in-use configuration a space for a user's fingers is defined between the link and the side wall of the container.

19. The jug of claim 17 wherein the link comprises a main elongate section and two substantially orthogonal terminal sections.

20. The jug of claim 18 wherein the link comprises a main elongate section and two substantially orthogonal terminal sections.

* * * * *